US008746226B2

(12) United States Patent
Lee

(10) Patent No.: US 8,746,226 B2
(45) Date of Patent: Jun. 10, 2014

(54) BACKWARD MOMENTUM GENERATING DEVICE WITH COUPLE SPRING BIASED ROD MECHANISMS FOR TOY GUN

(76) Inventor: Tsung-Ming Lee, Taipei (TW)

( * ) Notice: Subject to any disclaimer, the term of this patent is extended or adjusted under 35 U.S.C. 154(b) by 86 days.

(21) Appl. No.: 13/420,761

(22) Filed: Mar. 15, 2012

(65) Prior Publication Data

US 2013/0180512 A1 Jul. 18, 2013

(30) Foreign Application Priority Data

Jan. 17, 2012 (TW) ..... 101201072 A

(51) Int. Cl.
*F41B 11/00* (2013.01)
*F41A 33/06* (2006.01)

(52) U.S. Cl.
CPC ..... *F41A 33/06* (2013.01)
USPC ..... 124/56

(58) Field of Classification Search
USPC ..... 124/56, 65–68, 80, 1; 42/54–55, 57–58, 42/1.06; 446/405–406; 434/18; 267/167
See application file for complete search history.

(56) References Cited

U.S. PATENT DOCUMENTS

| | | | | |
|---|---|---|---|---|
| 5,857,854 | A * | 1/1999 | Kwalwasser | 434/18 |
| 6,003,503 | A * | 12/1999 | Johnson et al. | 124/69 |
| 8,449,346 | B2 * | 5/2013 | Lee | 446/405 |
| 2003/0098020 | A1 * | 5/2003 | Hu | 124/66 |
| 2008/0155875 | A1 * | 7/2008 | Iwasawa | 42/54 |
| 2009/0127758 | A1 * | 5/2009 | Hu | 267/167 |
| 2012/0240912 | A1 * | 9/2012 | Hu | 124/80 |

* cited by examiner

*Primary Examiner* — Stephen M Johnson
*Assistant Examiner* — Benjamin Gomberg

(57) ABSTRACT

A backward momentum generating device with coupled spring biased rod mechanism, being disposed through an internal wall settled between a housing and a stop wall of a toy gun, is disclosed. While a piston in the housing produces compressed air, a weight of the backward momentum generating device is pushed along a moving direction of the reciprocating motion of the piston, produces a reaction force, and results in an effect of a backward momentum applied to the housing of the toy gun. The coupled spring biased rod mechanisms include at least one front-section spring biased rod and at least one back-section spring biased rod, wherein the back-section spring biased rod is moveably disposed through a hollow channel formed in the weight of the toy gun.

7 Claims, 9 Drawing Sheets

BACKWARD MOMENTUM GENERATING DEVICE WITH COUPLE SPRING BIASED ROD MECHANISMS FOR TOY GUN

BACKGROUND OF THE INVENTION

1. Field of the Invention

The present invention relates to the design of toy gun structure, and in particular to a backward momentum generating device arranged inside a toy gun.

2. The Related Arts

Toy guns, such as BB guns, air guns, and pneumatic guns, are commonly used in survival games to mimic equipments for wars or training. A player of the survival game uses a toy gun to play a solider or a police troop to simulate a gun fighting game. This is currently popular to the public.

The conventional toy gun is provided with a backward momentum generating device that is arranged in a rear end of a housing of the toy gun behind a piston and is set along a moving path of reciprocal motion of the piston and comprises a guide rod, a weight, and a recoil spring. These three members collectively transmit the force induced by the piston in order to generate a shock of recoil force.

The conventional backward momentum generating structure effectively generates an effect of shock of recoil force. However, the recoil force induced by the recoil spring of the backward momentum generating structure is generally excessively large so that the structure of the guide rod cannot be completely cushion such a force and the excessive force may cause damage of a transmission unit coupled to the piston, eventually leading to reduced life span of the toy gun.

SUMMARY OF THE INVENTION

Thus, the primary object of the present invention is to provide a backward momentum generating device that overcomes the problem found in the conventional structure of backward momentum generating device.

The solution adopted in the present invention to address the technical issues comprises an extendible/retractable structure of a front-section rod and a back-section rod that substitutes the conventionally used movable guide rod and a weight that is made in a structure having a hollow channel. The front-section rod extends through an internal wall of a housing of the toy gun and comprises a front-section spring and a front-section inner tube, and the back-section rod is received in the hollow channel of the weight and comprises a back-section spring and a back-section inner tube. The weight is coupled to the front-section rod between the internal wall and a stop wall. The hollow channel that is formed in a moving direction of the reciprocal motion of the piston extends through the weight and the front-section rod.

When a player shoots, a transmission unit drives the piston and the piston spring is compressed. The front-section rod is moved with the weight toward the stop wall, until the back-section inner tube gets in contact with the stop wall. Under this condition, the back-section spring is compressed by the back-section inner tube. When the force compressing the piston spring is released, the piston is acted upon by the piston spring to eject a bullet. Under this condition, the weight and the front-section rod are acted upon by the spring force of the back-section spring to move toward the internal wall and at the same time, the stop wall is acted upon by a reaction force to produce an effect of shock of recoil force. When the weight reaches and is thus stopped by the internal wall, the back-section rod continuously moves and the front-section inner tube moves further toward the front-section spring and is eventually cushioned by the front-section spring to dissipate the residual force.

Compared to the conventional backward momentum generating device, the present invention uses the back-section inner tube and the back-section spring arranged in the back-section rod to produce an effect of shock of recoil force and further uses the front-section inner tube and the front-section spring arranged in the front-section rod to cushion and dissipate the residual force. This arrangement eliminates the need of installing a recoil spring at the stop wall and the extendible/retractable structure composed of the two sections of rod realizes an almost complete effect of cushioning to perfectly minimize the loss of the transmission unit and the piston and thus extends the life span of the toy gun.

BRIEF DESCRIPTION OF THE DRAWINGS

The present invention will be apparent to those skilled in the art by reading the following description of preferred embodiments of the present invention, with reference to the attached drawings, in which.

DETAILED DESCRIPTION OF THE PREFERRED EMBODIMENTS

Figure 1:
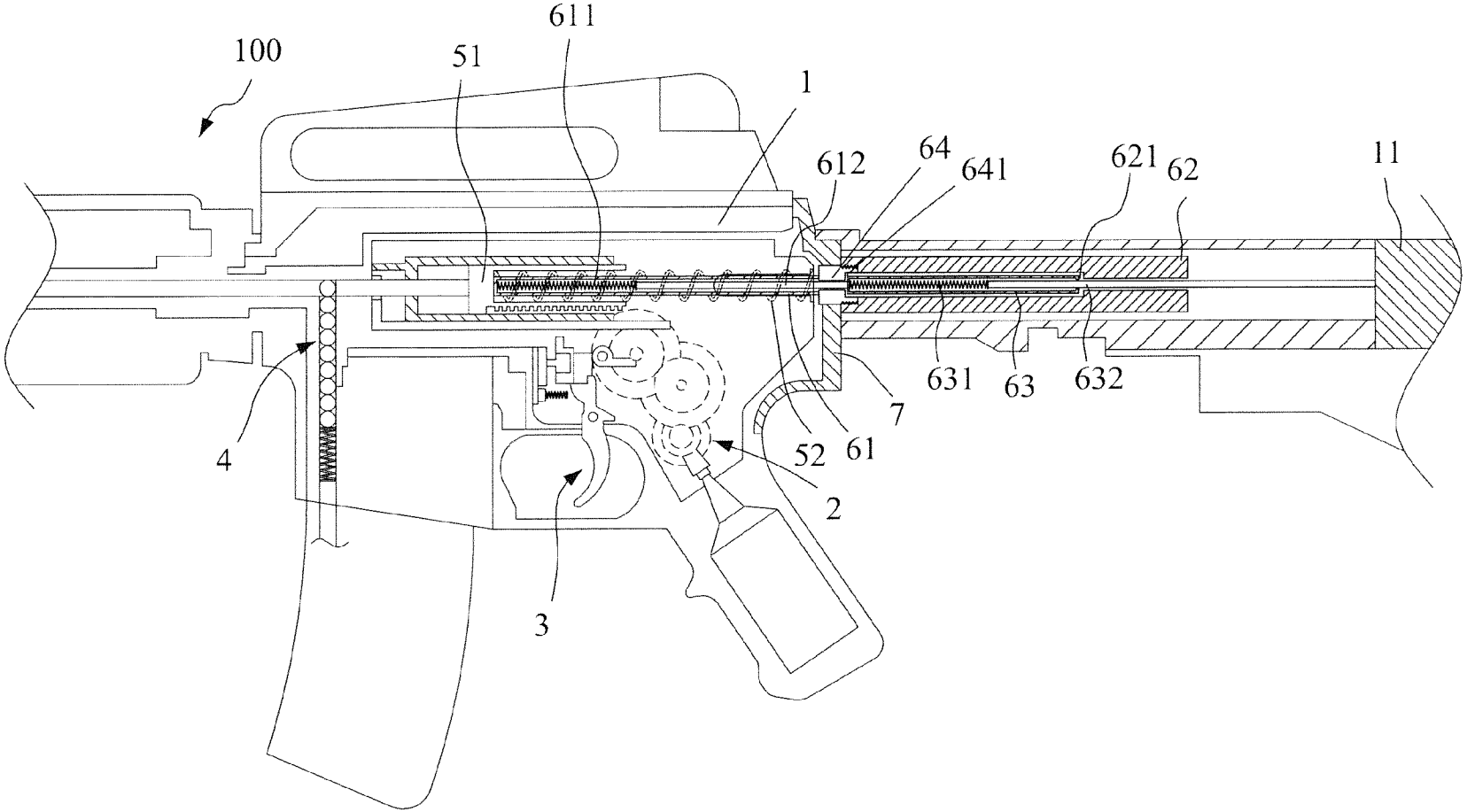
FIG. 1 is a schematic view showing the structure of a toy gun according to a preferred embodiment of the present invention.

With reference to the drawings and in particular to FIG. 1, a structure according to a preferred embodiment of the present invention applied to a toy gun is schematically shown. As shown in the drawing, the toy gun 100 generally comprises a housing 1 that has an internal space in which components including a transmission unit 2, a trigger unit 3, a bullet feeding unit 4, a piston 51, and a piston spring 52 are mounted.

Figure 2:
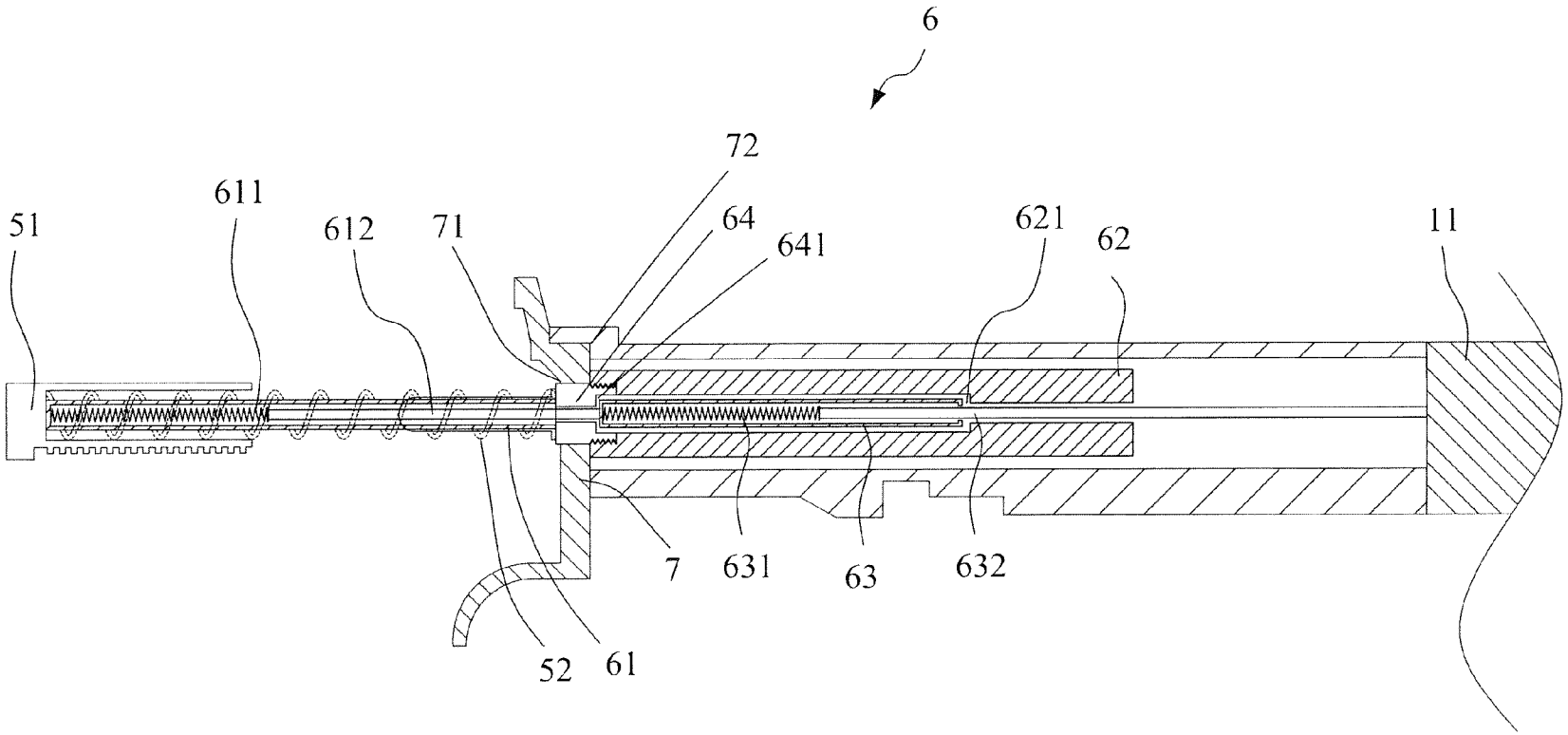
FIG. 2 is a schematic view illustrating the structure according to a preferred embodiment of the present invention.

Referring to FIGS. 1 and 2, FIG. 2 is a schematic view illustrating the structure according to the preferred embodiment of the present invention. As shown in the drawings, the toy gun 100 according to the present invention comprises a backward momentum generating device 6, which is arranged to extend through an internal wall 7 that is located between the housing 1 of the toy gun 100 and a stop wall 11. When the piston 51 produces compressed air in the housing 1, the backward momentum generating device 6 is pushed in a moving direction of reciprocal motion of the piston 51 so as to generate a reaction force on the stop wall 11 to produce an effect of recoil force of shooting.

The backward momentum generating device 6 comprises a front-section tube 61, which extends through the internal wall 7 into the housing 1 and is movable with the reciprocal motion of the piston 51 and comprises a front-section spring 611 and a front-section inner rod 612 mounted therein. The front-section spring 611 is fixed to an internal front surface of the front-section tube 61. The front-section inner rod 612 is arranged to a non-fixed end of the front-section spring 611 and extends beyond an internal back end of the front-section tube 61. A weight 62 is coupled to the front-section tube 61 and is located between the internal wall 7 and the stop wall 11 and forms therein a hollow channel 621. The front-section inner rod 612 extends through the internal back end of the front-section tube 61 into the hollow channel 621. A weight rod 63 extends from the front-section inner rod 612 and is received in the hollow channel 621 of the weight 62 and receives therein a back-section spring 631 and a back-section inner rod 632. The back-section spring 631 is fixed to an internal front surface of the weight rod 63. The back-section inner rod 632 is arranged to a non-fixed end of the back-section spring 631 and extends beyond an internal back end of the weight rod 63 and the hollow channel 621 of the weight 62 to reach engagement with the stop wall 11.

Further, the front-section tube 61 and the weight 62 are coupled to each other by a coupling plug 64. The coupling plug 64 comprises a stop 641, which constrains the weight rod 63 within the hollow channel 621 of the weight 62. The internal wall 7 further comprises a front surface 71 and a back surface 72. The front surface 71 fixes the piston spring 52, and the back surface 72 constrains the weight 62 outside the housing 1. When the piston 51 and the weight 62 are not in synchronization with each other in making reciprocal motion, the front-section. spring 611 of the front-section tube 61 and the back-section spring 631 of the weight rod 63 absorb a portion of the kinetic energy of the weight 62 to prevent the front end of the front-section tube 61 from directly impacting the piston 51 to cause undesired damage.

Figure 3:
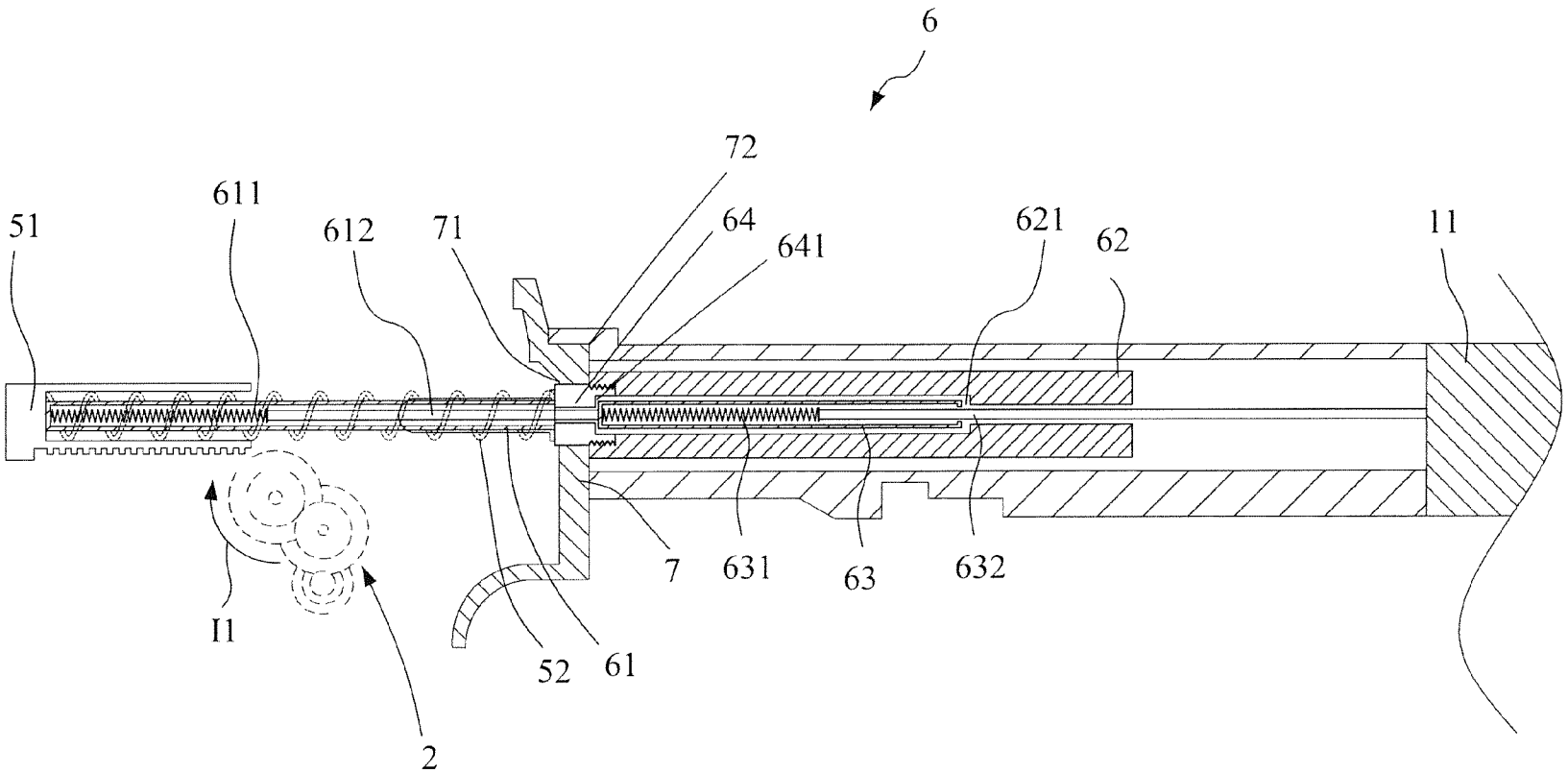
FIG. 3 is a schematic view showing a first step of the operation of the preferred embodiment of the present invention.
Figure 4:
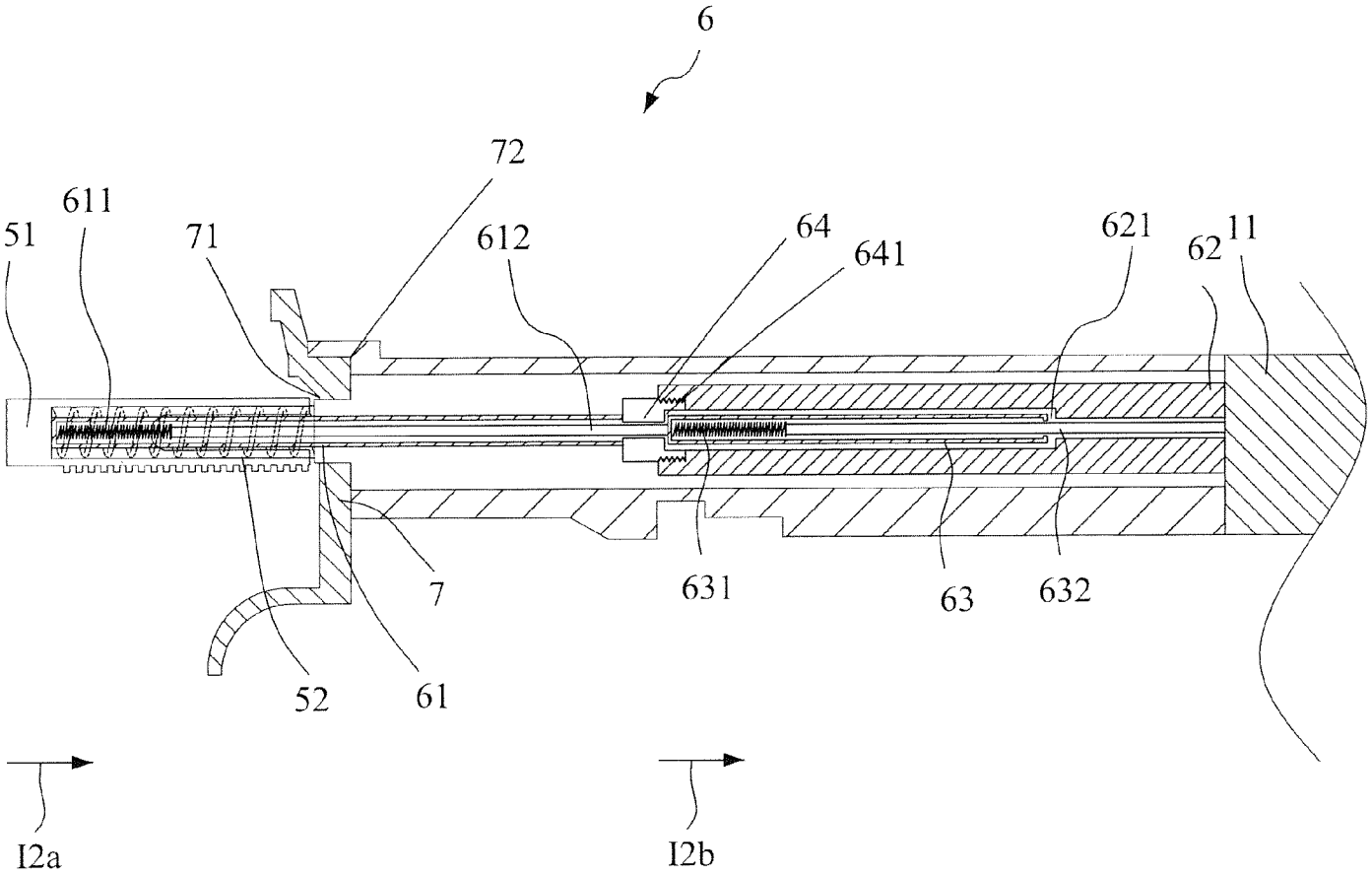
FIG. 4 is a schematic view showing a second step of the operation of the preferred embodiment of the present invention.

Referring sequentially to FIGS. 3-8, steps of the operation of the preferred embodiment according to the present invention are schematically illustrated. As shown in FIG. 3, when a user of the toy gun 100 activates the trigger unit 3, the trigger unit 3 drives the transmission unit 2. The transmission unit 2 in turn moves the piston 51 according to a transmission unit rotation direction 11. As shown in FIG. 4, the piston spring 52 is compressed by the piston 51 in a piston compression direction 12 *a* to position against the front surface 71 of the internal wall 7. The front-section tube 61 and the weight 62 are moved in a weight moving direction 12 *b* toward the stop wall 11 to have the back-section inner rod 632 positioned against the stop wail 11. Under this condition, the back-section spring 631 is compressed by the back-section inner rod 632 and the front-section spring 611 is compressed by the front-section inner rod 612.

Figure 5:
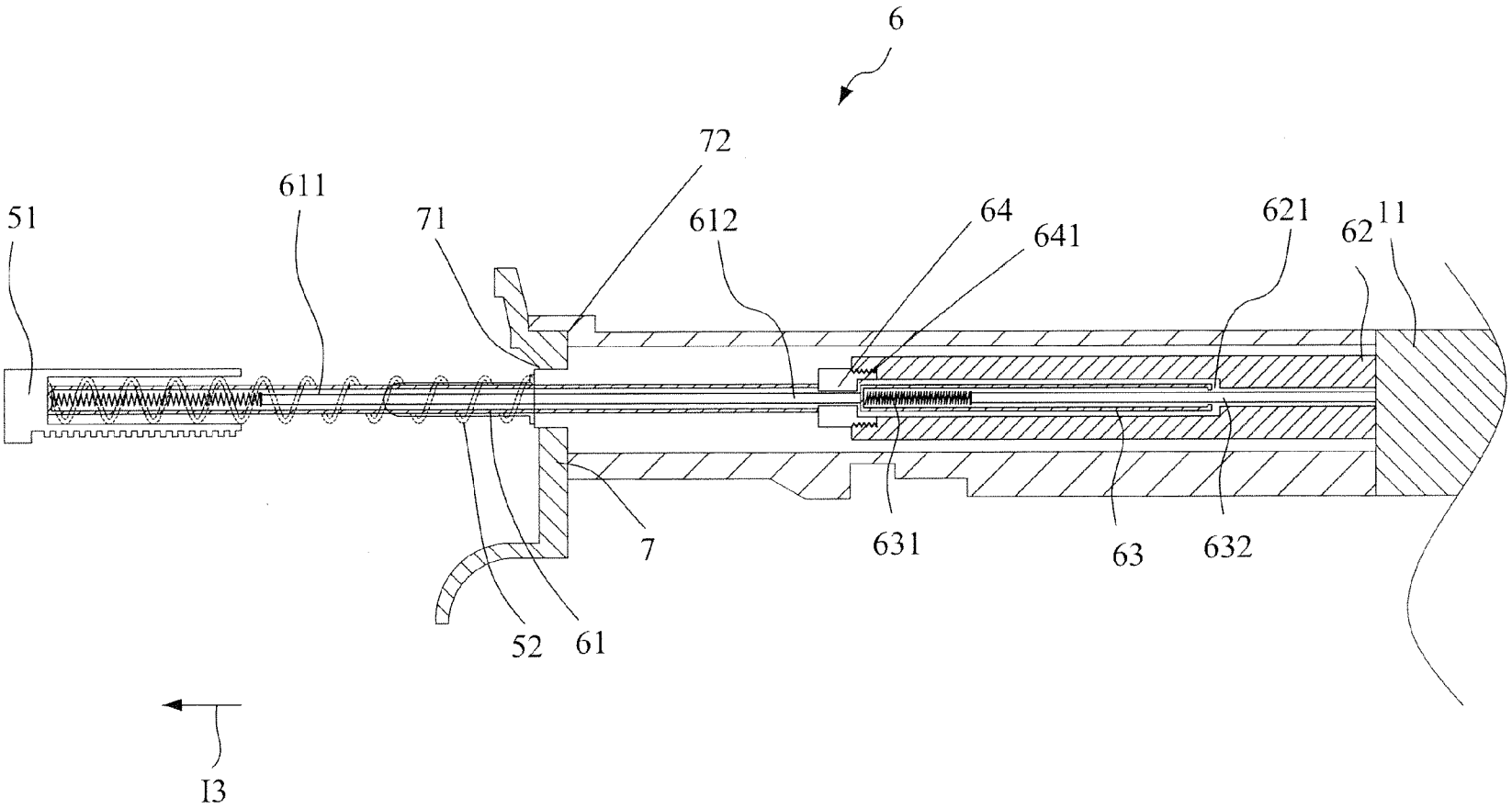
FIG. 5 is a schematic view showing a third step of the operation of the preferred embodiment of the present invention.
Figure 6:
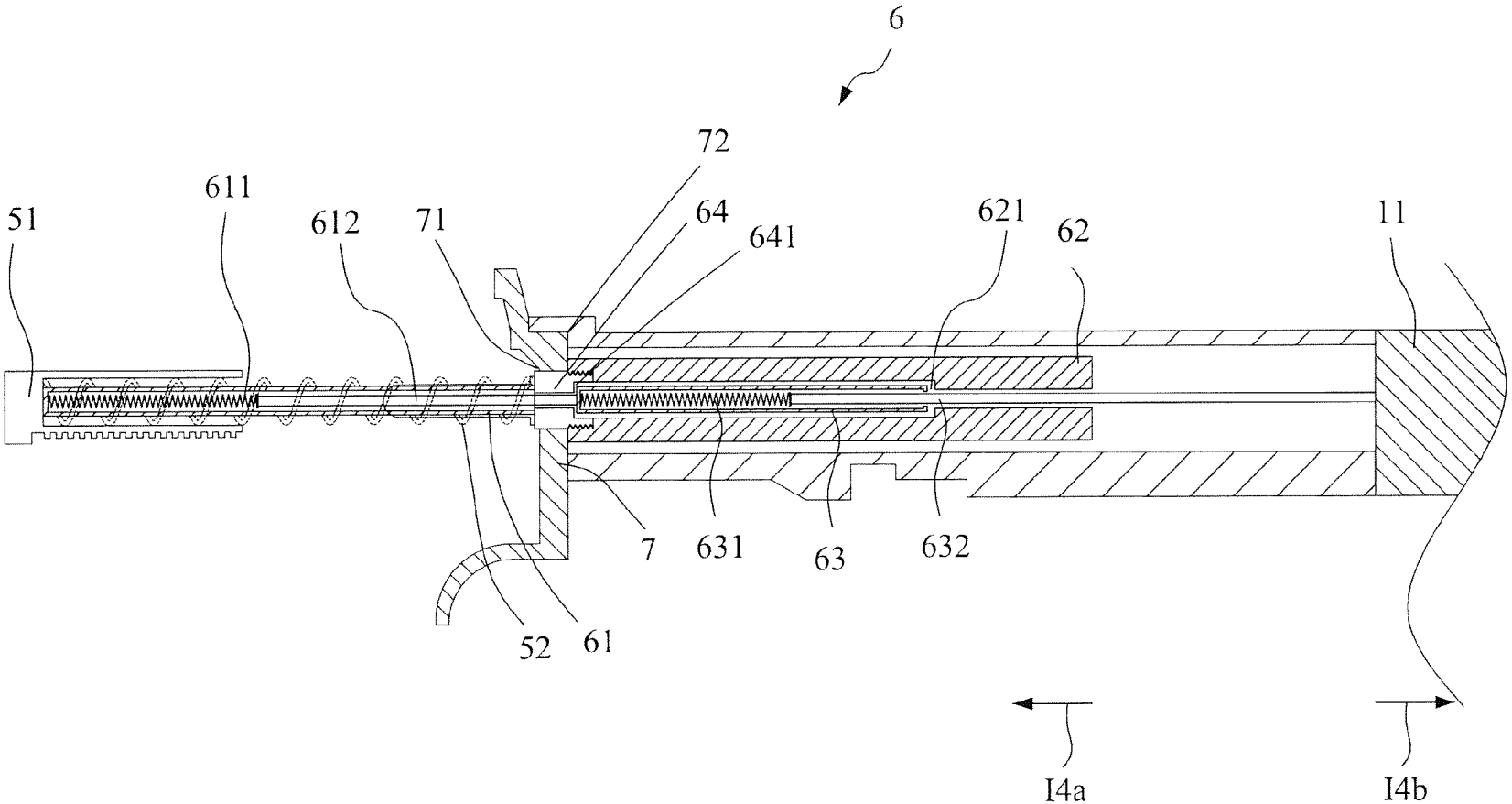
FIG. 6 is a schematic view showing a fourth step of the operation of the preferred embodiment of the present invention.

As shown in FIG. 5, when compression force against the piston spring 52 is released through a second-time activation of the trigger unit 2, the piston 51 is acted upon by the spring force of the piston spring 52 to eject a bullet in a piston release direction 13. As shown in FIG. 6, the weight 62. and the front-section tube 61 are acted upon by the spring force of the back-section spring 631 to move in a weight release direction 14 *a* toward the internal wall 7 until the weight 62 engages the back surface 72 of the internal wall 7. At the same time, the stop wall 11 is acted upon by a reaction force 14 *b* to produce an effect of shock of recoil force.

Figure 7:
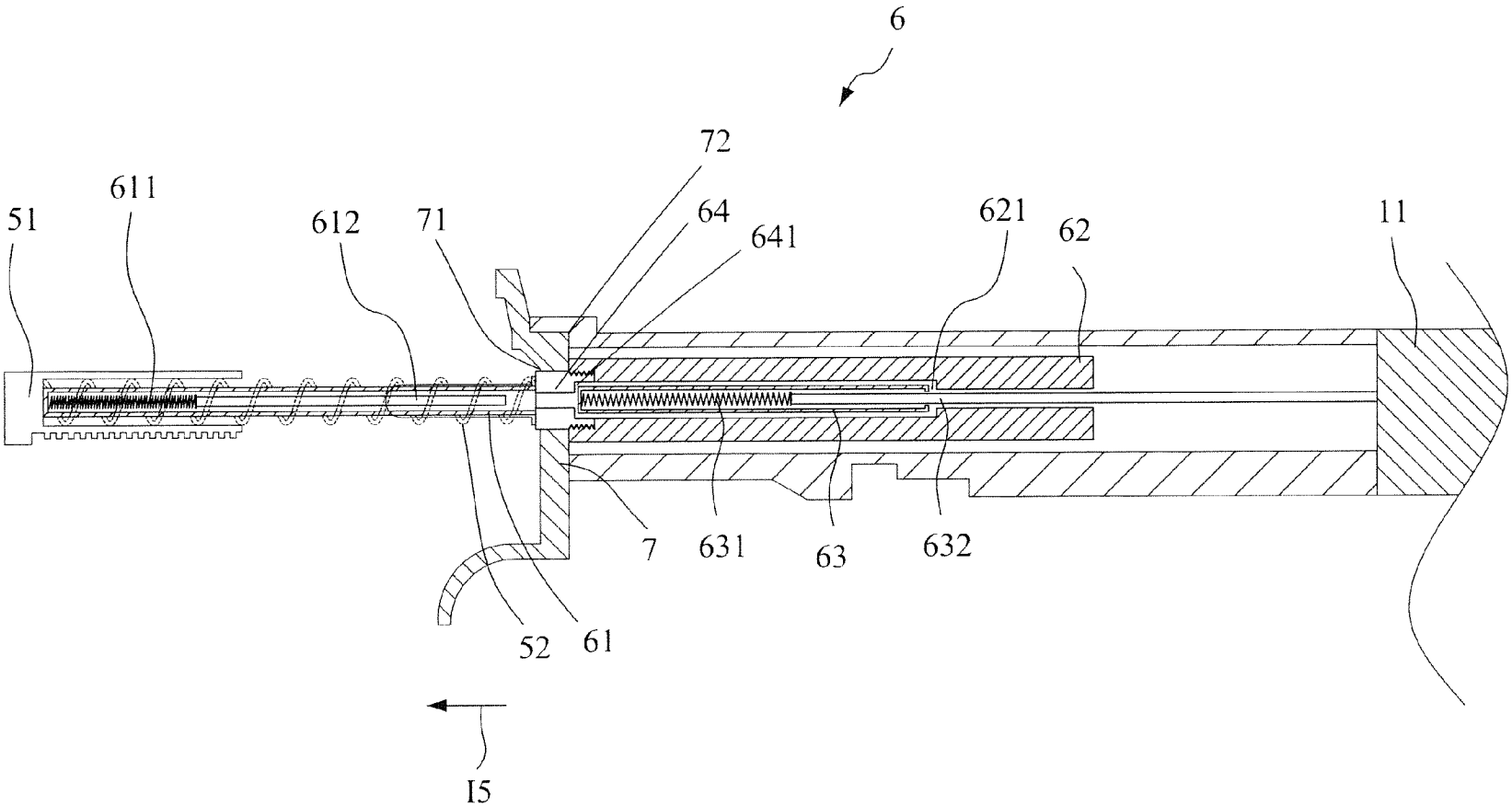
FIG. 7 is a schematic view showing a fifth step of the operation of the preferred embodiment of the present invention.
Figure 8:
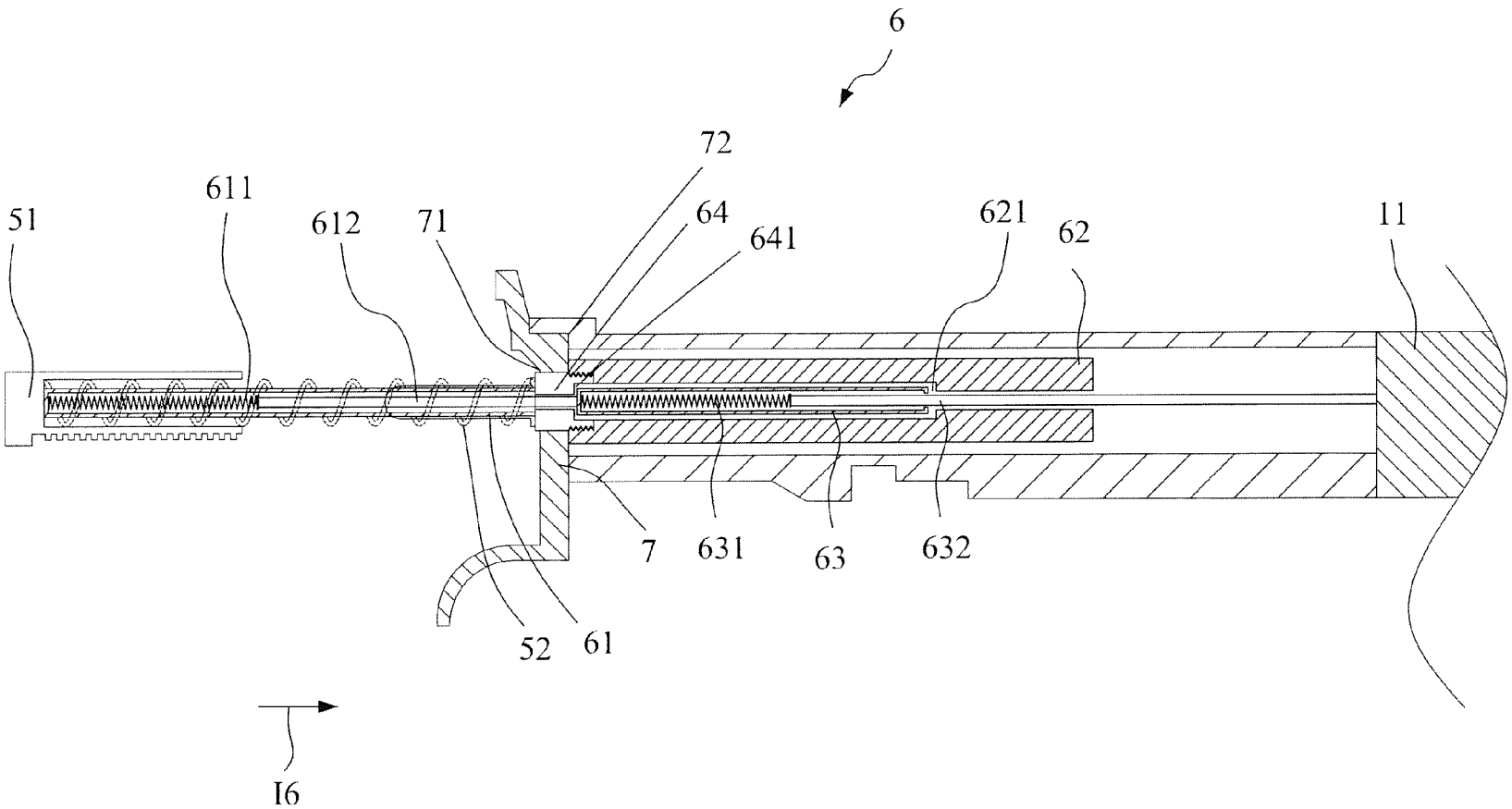
FIG. 8 is a schematic view showing a sixth step of the operation of the preferred embodiment of the present invention.

As shown in FIG. 7, when the weight 62 engages and thus is stopped the back surface 72 of the internal wall 7, the weight rod 63 continuously moves forward until reaches the stop 641 of the coupling plug 64, but the front-section inner 612 continues moving in a front-section inner rod compression direction 15 toward the front-section spring 611. As shown in FIG. 8, the front-section inner rod 612 is cushioned by the from-section spring 611 to dissipate the residual force. Finally, the front-section spring 611 forces the front-section inner rod 612 to move in a front-section inner rod release direction 16 toward the weight rod 63 until contact engagement is made with the weight rod 63. This completes the process of producing recoil force and cushioning operation.

Figure 9:
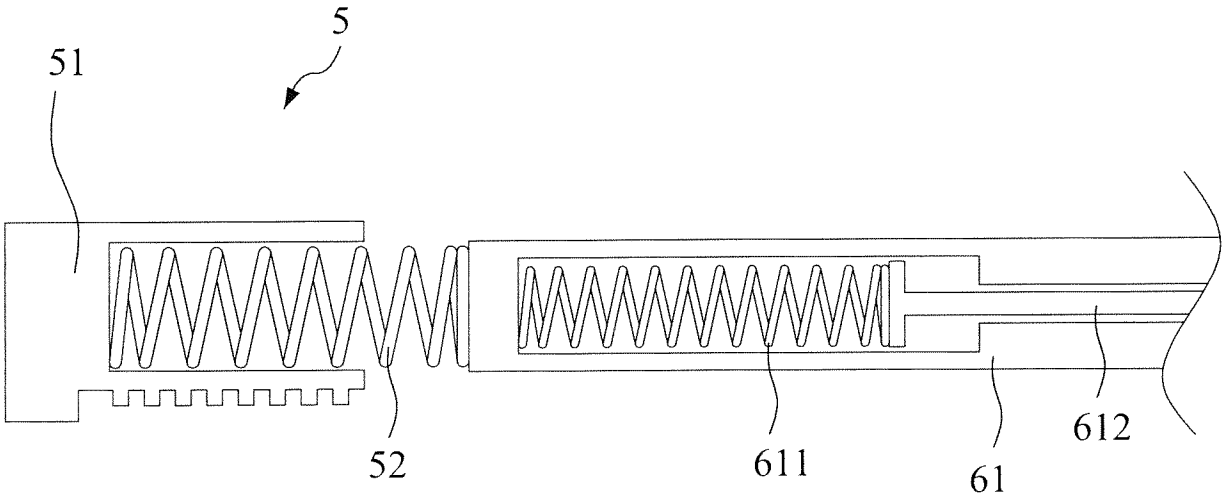
FIG. 9 is a schematic view showing the structure of a piston unit according to a second embodiment of the present invention.

Referring to FIG. 9, which schematically shows the structure of a piston unit according to a second embodiment of the present invention, as shown in the drawing, a piston unit 5 according to the present invention comprises a piston 51 coupled to a piston spring 52. Besides being fixed to the internal wall 7, the piston spring 51 can alternatively be arranged between the front-section tube 61 and the piston 51 and the operation is similar to the preferred embodiment discussed above. Repeated description will be omitted.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A backward momentum generating device for a toy gun arranged to extend through an opening in an internal wall located between a housing of the toy gun and a stop wall of the toy gun, wherein when a piston unit produces compressed air in the housing, the backward momentum generating device is pushed in a moving direction of reciprocal motion of the piston unit to induce a reaction force on the stop wall so as to produce an effect of shooting recoil force, characterized in that the backward momentum generating comprises:

a front-section tube, which extends through the opening of the internal wall into the housing and is movable with the reciprocal motion of the piston unit and comprises a front-section spring and a front-section inner rod received in the front-section tube, the front-section spring being fixed to an internal front surface of the front-section tube, the front-section inner rod being arranged at a non-fixed end of the front-section spring and extending outside an internal back end of the front-section tube;

a weight, which is coupled to the front-section tube between the internal wall and the stop wall and forms therein a hollow channel, the front-section inner rod extending through the internal back end of the front-section tube into the hollow channel; and a back-section tube, which extends from the front-section inner rod to be received in the channel formed through the weight and comprises a back-section spring within the hollow channel and a back-section inner rod received within the hollow channel, the back-section spring being fixed to an internal front surface of the back-section tube, the back-section inner rod being arranged at a non-fixed end of the back-section spring and extending beyond a back end of the back-section tube and the hollow channel of the weight to engage the stop wall.

2. The backward momentum generating device as claimed in claim 1, wherein the piston unit comprises a piston coupled to a piston spring, the piston spring being either fixed to the internal wall or arranged between the front-section tube and the piston.

3. The backward momentum generating device as claimed in claim 1, wherein the front-section tube and the weight are coupled by a coupling plug.

4. The backward momentum generating device as claimed in claim 1, wherein the coupling plug comprises a stop, which constrains the back-section tube in the hollow channel of the weight.

5. The backward momentum generating device as claimed in claim 1, wherein the internal wall comprises a front surface and a rear surface, the front surface fixing a piston spring of the piston unit, the rear surface constraining the weight outside the housing.

6. The backward momentum generating device as claimed in claim 1, wherein the piston unit and the weight are not in synchronization with each other in reciprocal motion.

7. The backward momentum generating device as claimed in claim 1, wherein the front-section spring of the front-section tube and the back-section spring of the back-section tube absorb a portion of the kinetic energy of the weight to prevent the front-section tube from directly impacting the piston unit to cause damage.

* * * * *